US006313743B1

(12) United States Patent
Abraham-Fuchs et al.

(10) Patent No.: US 6,313,743 B1
(45) Date of Patent: Nov. 6, 2001

(54) HOME EMERGENCY WARNING SYSTEM

(75) Inventors: Klaus Abraham-Fuchs, Erlangen; Thomas Birkhoelzer, Weisendorf; Alexander Herold, Erlangen; Helmut Reichenberger, Eckental; Volker Schmidt, Erlangen; Henrich Seifert, Bubenreuth, all of (DE)

(73) Assignee: Siemens Aktiengellschaft, Munich (DE)

( * ) Notice: Subject to any disclaimer, the term of this patent is extended or adjusted under 35 U.S.C. 154(b) by 0 days.

(21) Appl. No.: 09/463,915

(22) PCT Filed: Jul. 30, 1998

(86) PCT No.: PCT/DE98/02186

§ 371 Date: Apr. 6, 2000

§ 102(e) Date: Apr. 6, 2000

(87) PCT Pub. No.: WO99/06979

PCT Pub. Date: Feb. 11, 1999

(30) Foreign Application Priority Data

Aug. 1, 1997 (DE) ..... 197 33 408

(51) Int. Cl.[7] ..... G08B 26/00

(52) U.S. Cl. ..... 340/505; 340/506; 340/541; 340/565; 340/567

(58) Field of Search ..... 340/505, 506, 340/541, 552, 553, 554, 555, 556, 557, 565, 566, 567

(56) References Cited

U.S. PATENT DOCUMENTS 5,086,385 * 2/1992 Launey et al. ..... 340/825.37 X

* cited by examiner

*Primary Examiner*—Daryl Pope
(74) *Attorney, Agent, or Firm*—Schiff Hardin & Waite

(57) ABSTRACT

In an autonomous emergency monitoring system, wherein the user need not carry any signaling devices whatsoever, an emergency situation can be reported to an external receiver by voice input via microphones via a communication interface. Further, a monitoring of the person can ensue via sensor systems that can likewise setup an external connection via the communication interface.

7 Claims, 1 Drawing Sheet

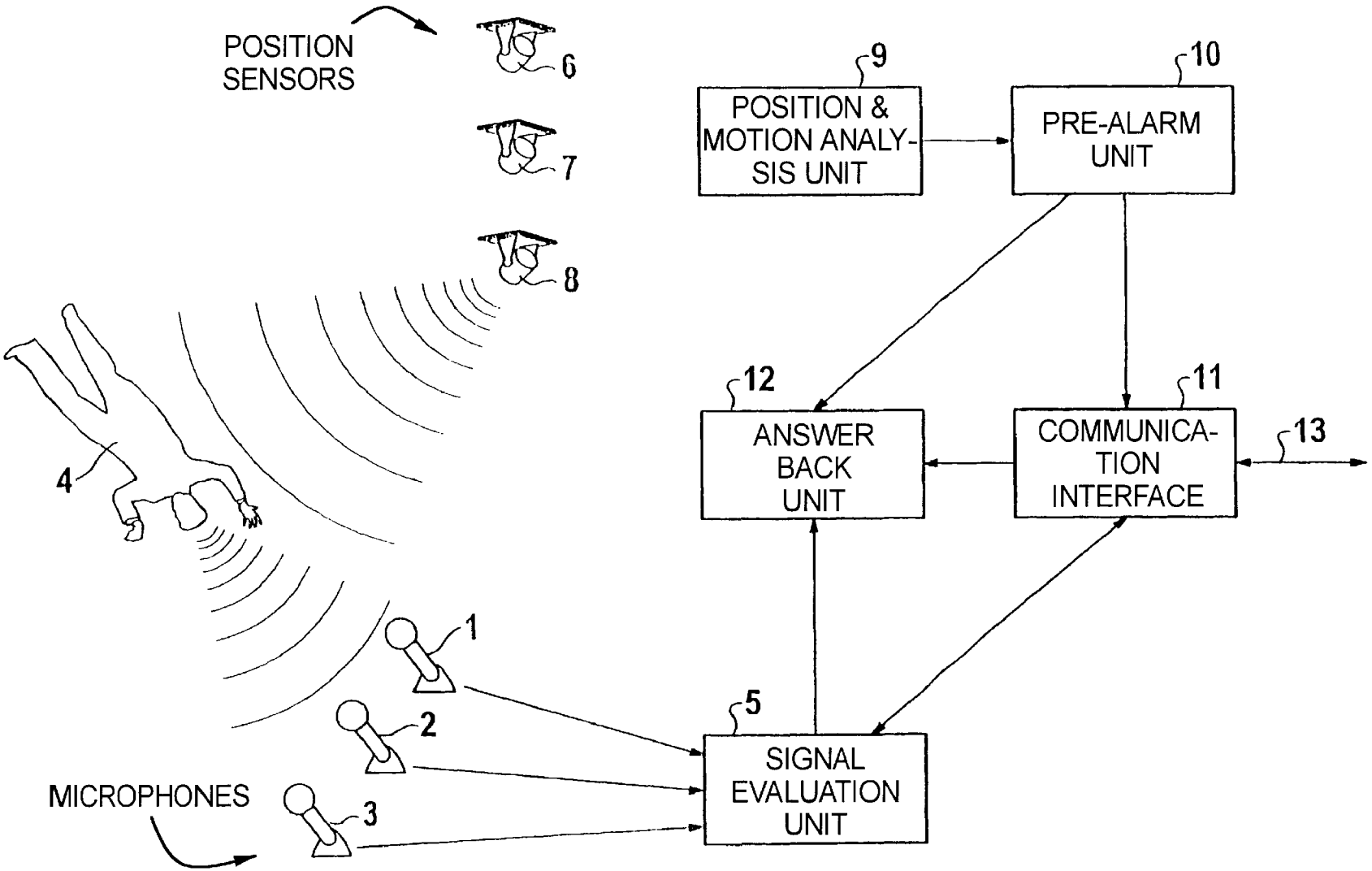
POSITION & MOTION ANALY-SIS UNIT
9
PRE-ALARM UNIT
10
COMMUNICA-TION INTERFACE
11
13
ANSWER BACK UNIT
12
SIGNAL EVALUATION UNIT
5
POSITION SENSORS
6
7
8
1
2
3
4
MICROPHONES

HOME EMERGENCY WARNING SYSTEM

BACKGROUND OF THE INVENTION

1. Field of the Invention

The present invention is directed to an emergency monitoring system for monitoring a person in a dwelling.

2. Description of the Prior Art

In case of an emergency, a serious illness or an accident in one's own dwelling, persons who live alone must summon external assistance, usually by telephoning relatives, a physician or an emergency center. There are many situations wherein this is problematical for the affected party, for example because (after falling) the person can no longer reach the telephone or can no longer act with appropriate direction (when unconscious or due to mental confusion). The affected persons are then helpless in their own dwelling and may have to wait for assistance for a very long time.

There are various emergency call systems for home use wherein a signal means, for example an alarm button, must be worn on the body. Upon actuation of this alarm button, the appertaining receiving station—which is usually coupled to the telephone—triggers an emergency call to a predetermined number. This has two serious disadvantages:

First, the signal means must always be carried along by the user, for example even when bathing (a focal point of accidents). This also assumes that a corresponding awareness of a problem is present in the case of the affected party (admitting one's own need for assistance).

Second, active collaboration of the user is always necessary. This is problematical, for example, given unconsciousness or mental confusion.

Further, German AS 29 22 542 discloses a security system for monitoring individual persons wherein a device to be worn on the body of an individual person monitors a signal derived from the pulse of the individual person in common with a signal adjustable in time sequence and, given failure of these signals to arrive, sends an identifier to the individual person. When this identifier is not deleted, an emergency call is sent to a central office. In this case as well, the device must always be worn on the body, so that a continuous monitoring is not always assured.

SUMMARY OF INVENTION

It is an object of the present invention to provide an emergency monitoring system of the types initially described, wherein the user can easily trigger an alarm as needed without signal devices at the body.

The object is achieved in accordance with the principles of the present invention in an emergency monitoring system for dwellings having a number of signal pick-ups for non-contacting communication with a person in the dwelling, that are connected via signal evaluation units to a communication interface for communication with an external receiver, with the signal pick-ups having respective pick-up fields that cover the entire area of the dwelling.

The invention is a completely autonomous emergency monitoring system, i.e. an emergency monitoring system wherein the user need not carry any signaling devices whatsoever along within the entire area, for example his dwelling, but with which he can nonetheless trigger an alarm always and everywhere and that, moreover, automatically and independently recognizes certain emergency situations and correspondingly reacts. When needed, the system allows an alarm (emergency message) to be sent to an arbitrary, receiving location, for example relatives, house doctor, emergency center. For transmitting the alarms, the system can be coupled to the telephone or, respectively, can also be optionally directly connected to arbitrary transmission links via an integrated interface.

It has proven advantageous when the signal pickups arc stationarily arranged. The signal pickups can thereby be microphone systems that are connected to a command recognition unit or can be sensor systems for wireless locating of the person that are connected to a unit for position and motion analysis, whereby the units are connected to the communication interface.

Inventively, the apparatus can setup an external connection only after appropriate answer back by the person or after omission of an answer back.

DESCRIPTION OF THE DRAWING

The single FIGURE is a a schematic block diagram of an emergency monitoring system constructed and operating in accordance with the principles of the present invention.

DESCRIPTION OF THE PREFERRED EMBODIMENTS

The drawing shows microphone systems 1 through 3 that have respective pick-up fields ("fields of view") which therefor cover the entire dwelling of a person 4 and that are connected to a command recognition unit 5. Further, sensor systems 6 through 8 are provided that, for example, work on the basis of infrared emission of radar emission and can likewise cover the entire dwelling. The sensor systems 6, 7, 8 are connected to a position and motion analysis unit 9. Further, a pre-alarm unit 10, a communication interface 11, an answer back unit 12 for The emergency system in accordance with the invention is composed of two basic components, namely a voice-actuatable emergency call system and an automatic monitoring system.

The voice-actuatable emergency call system reacts to voice input obtained via the microphone systems 1 through 3 and recognizes specific key words in order to trigger an alarm. Preferably this system (microphone systems 1–3 and a speaker) can also set up a voice connection in the event of an alarm between a calling party (a user such as the person 4) and a called party (for example an emergency center). The system is constructed in modules so that the microphones and speakers can be installed in every room of the dwelling, so that triggering an alarm solely by speech is possible from every location within the dwelling, without the person 4 having to reach a communication device such as a telephone. This is important, for example, if the person 4 is lying on the floor of the dwelling and is incapable of moving, such as after falling.

The automatic monitoring system of the dwelling is composed of the sensor systems 6 through 8 for identifying the current location of the person 4. The sensor systems 6 can be infrared sensors, radio-frequency sensors, or electromagnetic sensors, as examples. The person for (or multiple persons) can be detected, for example, on the basis of heat radiation or on the basis of typical motion patterns (for example, heartbeat, respiration/motor functions). The sensor systems 6 can be installed as modules so that monitoring of the entire dwelling is possible. The measured values obtained from the sensor systems 6 are suitably processed for recognizing emergency situations.

Such processing can take place according to several techniques. For example, regions wherein a long-duration presence is not normally expected are defined in the dwelling, for example on the floor. When the person 4 is recognized to be in one of these regions for a longer-than-expected time interval (for example, several minutes), then a pre-alarm is triggered.

Another monitoring technique can be to generate a movement, activity an/or location profile representing the movement, activity and/or location of the person 4 throughout a day, or a portion of a day. When this profile differs significantly from the normal behavior of the person 4, as represented by a stored profile, for example, if the person 4 exhibits significantly reduced movement over a longer time span, it is assumed that the person 4 is experiencing a coma or a serious illness, and a pre-alarm is triggered.

The automatic monitoring can be combined with the pre-alarm, i.e. the system signals the person 4 via the answer back unit 12 that an unusual situation has been recognized, using optical or acoustic means. The person 4 then has the opportunity of deactivating the alarm, for example by a change in behavior or voice commands. Only when no reaction ensues is an alarm triggered toward the outside. The person 4, however, can also immediately cancel an intentional alarm by appropriate signaling.

The invention represents a combination of existing technologies from various areas of household automation to form a completely autonomous emergency monitoring system, i.e. an emergency monitoring system wherein the user need not carry any type of signaling devices whatsoever.

Although modifications and changes may be suggested by those skilled in the art, it is the intention of the inventors to embody within the patent warranted hereon all changes and modifications as reasonable and properly come within the scope of their contribution to the art.

We claim:

1. An emergency monitoring system for a dwelling, comprising:

a plurality of signal pick-ups for non-contacting passive interaction with a person within a dwelling, said signal pick-ups having respective pick-up ranges for covering an entire area of said dwelling and including a plurality of position sensors, each generating a signal dependent on a position of said person in said dwelling;

a signal evaluation unit connected to said signal pick-ups, including a position and motion analysis unit for analyzing the respective signals from said sensors to identify the position of said person in said dwelling and to determine if an emergency situation exists based on the position of said person in said dwelling; and a communication interface connected to said signal evaluation unit for transmitting a signal to an external receiver if said emergency situation is found to exist.

2. a system claimed in claim 1 wherein said signal pick-ups are stationarily mounted in said dwelling.

3. A system as claimed in claim 1 further comprising an answerback unit for communication with a person, connected to said voice command recognition unit, and wherein said voice command recognition unit causes said communication interface to communicate with said external receiver only after said answerback unit receives an answer back from a person.

4. A system as claimed in claim 3 further comprising a pre-alarm unit connected to said answerback unit, which informs a person that said communication interface will communicate with said external receiver, and wherein said voice command recognition unit allows said communication interface to communicate with said external receiver only in an absence of an answer back via said answerback unit.

5. A system as claimed in claim 1 further comprising an answerback unit for communication with a person, connected to said voice command recognition unit, and wherein said voice command recognition unit causes said communication interface to communicate with said external receiver only in an absence of an answer back via said answerback unit.

6. A system as claimed in claim 1 further comprising a pre-alarm unit connected to said position and motion analysis unit, and an answerback unit connected to said pre-alarm unit for communicating with said person, and wherein said position and motion analysis unit allows said communication interface to communicate with said external receiver only after receiving an answer back from said person via said answerback unit.

7. A system as claimed in claim 1 further comprising a plurality of signal pick-ups for non-contacting active communication with said person within said dwelling, including a plurality of microphones for receiving voice commands from said person, and wherein said signal evaluation unit includes a voice command recognition unit for identifying and evaluating voice commands.

* * * * *